US006989637B2

(12) United States Patent
Chen et al.

(10) Patent No.: US 6,989,637 B2
(45) Date of Patent: Jan. 24, 2006

(54) METHOD AND APPARATUS FOR A VOLTAGE CONTROLLED START-UP CIRCUIT FOR AN ELECTRONIC BALLAST

(75) Inventors: Timothy Chen, Aurora, OH (US); James D. Mieskoski, Seven Hills, OH (US); Virgil Chichernea, Rocky River, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/667,545

(22) Filed: Sep. 22, 2003

(65) Prior Publication Data

US 2005/0062425 A1 Mar. 24, 2005

(51) Int. Cl.
*H05B 37/02* (2006.01)

(52) U.S. Cl. ..... 315/224; 315/209 T; 315/DIG. 7

(58) Field of Classification Search ..... 315/224–225, 315/209 T, 209 CD, 244, 246–247, 276, 315/291, 307, DIG. 7; 307/140–141; H05B 37/02
See application file for complete search history.

(56) References Cited

U.S. PATENT DOCUMENTS

| | | | | |
|---|---|---|---|---|
| 5,177,408 A | | 1/1993 | Marques | 315/291 |
| 5,838,181 A | * | 11/1998 | Hesterman | 327/175 |
| 6,222,322 B1 | * | 4/2001 | Stack | 315/119 |
| 6,781,326 B2 | * | 8/2004 | Stack | 315/291 |

* cited by examiner

*Primary Examiner*—Thuy Vinh Tran
(74) *Attorney, Agent, or Firm*—Fay, Sharpe, Fagan, Minnich & McKee, LLP

(57) ABSTRACT

A voltage control startup circuit for a lighting ballast includes first and second transistors for converting direct current from a voltage source into alternating current to operate a lamp. The circuit includes an input portion for receiving a bus voltage signal, a resonant load portion for receiving a lamp load. The ballast also includes a start-up portion that delays firing of the lamp based on the detected bus voltage.

13 Claims, 5 Drawing Sheets

METHOD AND APPARATUS FOR A VOLTAGE CONTROLLED START-UP CIRCUIT FOR AN ELECTRONIC BALLAST

BACKGROUND OF THE INVENTION

The present application relates to ballasts, and power supply circuits for gas discharge lamps. It finds particular application for use with current fed instant and/or rapid start electronic ballasts or power supply circuits and will be described with particular reference thereto. It is to be appreciated, however, that the present application is also applicable to other inverter circuits, and is not limited to the aforementioned use.

In the late eighties, and early nineties, the lighting industry began to make a shift from passive power and harmonic correction circuits to active power correction and harmonic circuits in the form of active pre-regulators for use in conjunction with electronic lamp ballasts. An advantage of active power factor and harmonic correction via active pre-regulators is that bus voltage variation can be virtually eliminated even though there are still voltage variations on the input line. The visible effect of this change is less variation in lumen output, that is, lamps connected to active pre-regulator circuits exhibit steadier intensities than lamps connected to circuits without active pre-regulation.

While the use of active pre-regulators has provided improved performance in certain areas, new problems have arisen when these pre-regulators are put into operation with rapid and/or instant-start ballasts or power supply circuits. Particularly, systems employing active pre-regulators require a significant amount of time to reach steady state operating conditions during start-up. This may result in undesirable operating conditions for the gas discharge lamps when the less than steady state operating voltages are passed through the converter section during this transient start-up condition.

During normal operation, which is a steady state condition, the active pre-regulator will provide a pre-determined DC voltage output, whose value will be dependent on the circuit design and/or lamp being driven, but in many instances may be up to a 500 V DC output. During the transient start-up condition, the output will be substantially below the desired steady state voltage conditions. Therefore, when operating in rapid and instant start modes the voltage supply will not be at steady state, and may result in an undesirable effect of unacceptable "preheat" or glow periods at this lower voltage. Instant-start lamps are typically specified to be operated in a glow discharge mode for a very short time period, approximately for no more than 100 milliseconds. This is a requirement since longer "preheat" periods will act to shorten lamp life due to excessive electrode erosion during these glow discharge conditions. Additionally, when operating in low voltage (i.e. non-steady state conditions), undesirable visible phenomena such as lamp flickering may occur. Therefore, it is considered desirable to delay the start-up operation of an electronic ballast for instant-start type fluorescent lamps until a pre-determined DC bus voltage has been substantially reached.

One particular attempt to address this issue is set forth in U.S. Pat. No. 5,177,408 to Marques which issued Jan. 5, 1993. This patent disclosed a time delay circuit of an electronic ballast for "instant-start" type fluorescent lamps of the type having an electronic converter powered by an active electronic pre-regulator. The inverter is described as an inductive-capacitive parallel-resonant push-pull circuit or other type of current-fed power-resonant circuit. The start-up circuit may be either a resistor and Zener diode or a resistor, capacitor, and diac network programmable unijunction transistor circuit connected between the pre-regulator output and an oscillation-enabling input of the inverter. The active electronic pre-regulator is designed so that it takes a pre-determined start-up time to reach steady state operating conditions. This delay device is connected between the pre-regulator and the converter.

Drawbacks to the above disclosed design exist. For example, to minimize design and development cost, to lower the number of different products (i.e. SKUs), to simplify inventory control, and to address global market needs, ballasts or power supply circuits having universal input capabilities have become a key selling point. In theory, a device is considered a universal input device if it is capable of operating cooperatively with the various standardized line voltages supplied in different parts of the world. For example, the standard line voltage in the United States is 120 V, in China it is 220 V, and in Europe, 230 V. A universal device would also preferably be able to operate with industrial line voltages which is currently 277 V in the United States.

The aforementioned U.S. Pat. No. 5,177,408 is, however, dependent on the input line voltage to obtain its time delay. This means to obtain a pre-determined time delay, it would be necessary to take into consideration the line voltage with which the device will be operating. Such a device would not therefore be considered a universal input ballast or power supply. Particularly, if a unit were used with a 120 V input line, the time delay would be different than if that unit were receiving a 230 V input line. Thus, this approach does not take full advantage of active power factor correction control.

BRIEF DESCRIPTION OF THE INVENTION

In accordance with one aspect of the present application, a lamp inverter circuit is provided. The lamp inverter circuit includes a switching portion that converts a DC signal to an AC signal. Further, the circuit includes an input portion for receiving a line voltage signal, a resonant load portion for receiving a lamp load, and a voltage controlled start-up portion that controls the ignition of the lamp based on a detected voltage.

In accordance with another aspect of the present application, a method of firing a lamp is provided. An AC line voltage is supplied and converted into a DC bus voltage. A charging capacitor is charged by the bus voltage. A breakdown voltage of a diac is overcome, turning the diac conductive, supplying current to oscillation of the inverter circuit.

In accordance with another aspect of the present application, a lamp ballast is provided. The lamp ballast includes a switching portion that includes first and second bipolar junction transistors. The ballast also includes a resonant load portion for receiving a lamp, a power factor correction circuit for delivering a bus voltage, and a voltage dependent start-up portion that controls firing of the lamp until the bus voltage ramps up to a pre-determined threshold.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE INVENTION

Figure 1:
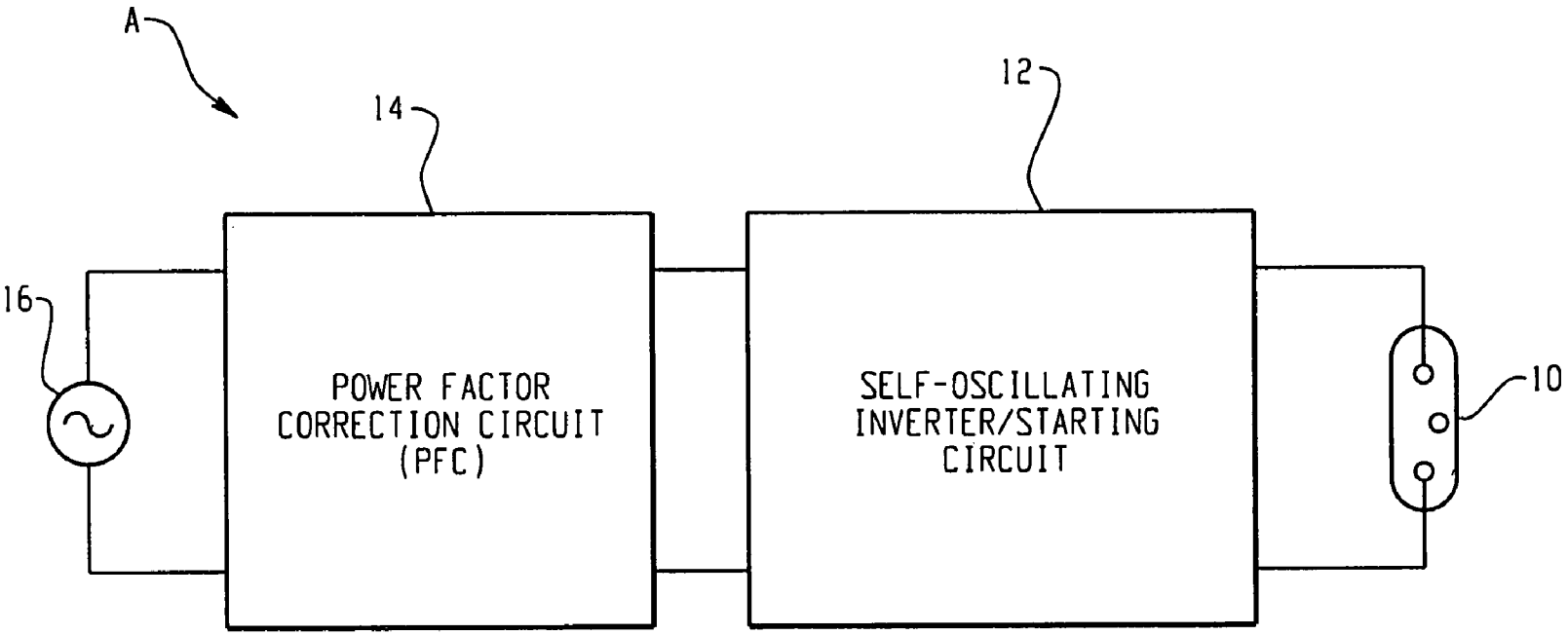
FIG. 1 is a block diagram of a lamp system.

With reference to FIG. 1, lamp circuit A includes a lamp assembly 10 operably connected to a bus voltage sensing and self-oscillating inverter/starting circuit 12. The lamp assembly 10 can be a gas discharge lamp or a plurality of gas discharge lamps, such as linear fluorescent or compact fluorescent lamps that operate at a particular frequency or range of frequencies. In one embodiment, the inverter starting circuit 12 is connected to power factor correction (PFC) circuit 14, such as an active power factor correction circuit which regulates a line voltage, corrects harmonics and supplies a bus voltage to inverter starting circuit 12. It is to be understood that PFC circuit 14 may provide passive power correction in an alternate embodiment. An AC voltage source 16 supplies an alternating current signal to the PFC circuit 14. The voltage source 16 can deliver a wide range of signals. Currently in the United States, the standard wall socket delivers a 120 V RMS voltage. The standard line voltage in China is 220 V, and Europe is higher, at about 230 V. Other sources, such as ones used for more industrial applications can deliver voltages of 277 V or higher. In one embodiment, the resulting bus voltages produced by PFC 14 range from 169 V (with a 120 V input) to 390 V (with a 277 V input), or more. The PFC circuit 14 can accept an input line voltage in the above disclosed range, in addition to accommodating higher or lower input voltages. Active and/or passive power factor correction circuits of this type are well known in the art, and therefore a detailed description of their operation is not undertaken here.

Figure 2:
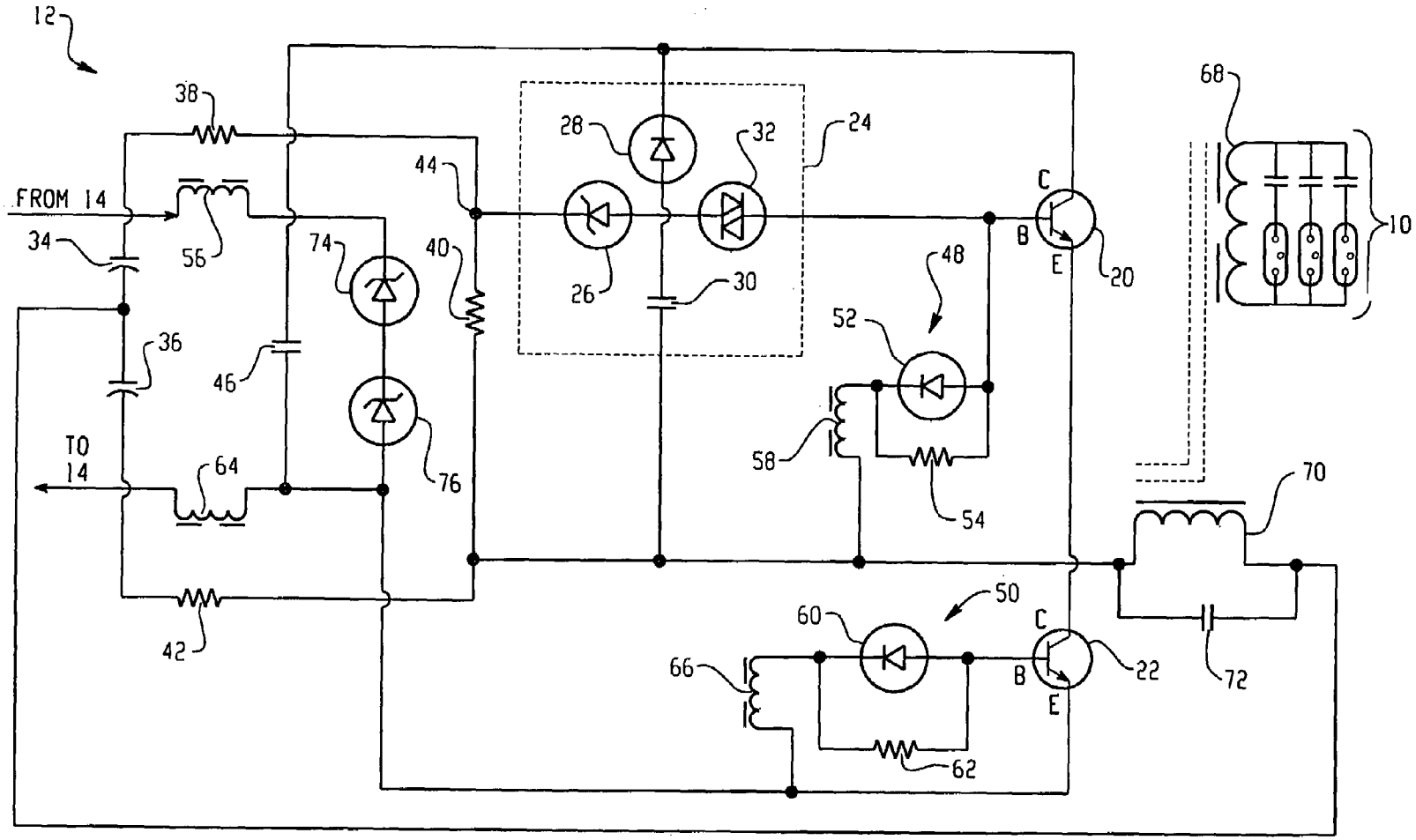
FIG. 2 is a circuit diagram of ballast inverter circuit included in the lamp system shown in FIG. 1 with a start up portion operably connected with a high side switch of the inverter circuit.

With reference to FIG. 2, illustrated is a detailed view of the inverter starting circuit 12 in a current fed half bridge inverter implementation. In order to convert a DC bus signal into an AC signal, a first transistor 20 and a second transistor 22 alternate between periods of conductivity and periods of non-conductivity, out of phase with each other. That is, when the first transistor 20 is conductive, the second transistor 22 is non-conductive, and vice-versa. The transistors 20, 22 are part of a switching portion of the inverter circuit 12. The action of alternating periods of conduction of the transistors provides an AC signal to the lamp assembly 10. In the embodiment illustrated in FIG. 2, the transistors are bipolar junction transistors (BJTs), but it is to be understood the concepts of the present application may be incorporated in other inverter circuits, such as known in the art. For example, the following descriptions may be implemented with BJTs in both half-wave current fed ballasts and push-pull type current fed electronic ballasts, among others.

In this embodiment, each transistor 20, 22 has a respective base, (B) emitter, (E) and collector (C). The voltage from base to emitter on either transistor defines the conduction state of that transistor. That is, the base to emitter voltage of transistor 20 defines the conductivity of transistor 20 and the base to emitter voltage of transistor 22 defines the conductivity of transistor 22. In the illustrated embodiment neither of the transistors 20, 22 are conductive when current is initially supplied by the PFC circuit 14 to the inverter starting circuit 12. As will be expanded upon below, a start-up portion 24 of the inverter circuit prevents current from being supplied to the transistors 20, 22 before the bus voltage from the PFC circuit 14 reaches a predetermined threshold voltage. The start-up portion includes Zener diode 26, diode 28, capacitor 30, and diac 32.

The potential difference across capacitors 34 and 36 is equivalent to the bus voltage from the PFC circuit 14. In one embodiment, capacitors 34 and 36 are of equal value, so that the voltage across capacitor 34 is the same as the voltage across capacitor 36. In parallel with capacitors 34 and 36 are resistors 38, 40, and 42. Resistors 38 and 40 form a voltage divider at node 44 and current is supplied to the start-up portion 24 through voltage divider 38, 40.

When power is first applied to the inverter starting circuit 12, Zener diode 26 and diode 28 prevent any significant current from passing through start-up portion 24. As the bus voltage ramps up, after power is initially supplied to inverter starting circuit 12, a portion of the circuit current charges capacitors 34 and 36, other current charges snubber capacitor 46, and the remaining current flows through resistors 38, 40, and 42. Initially, because the bus voltage is divided by resistors 38 and 40, a breakdown voltage of Zener diode 26 is not reached, and Zener diode 26 prevents current from passing through start-up portion 24.

Eventually, the bus voltage from PFC 14 ramps to a level where the potential at node 44 is greater than the breakdown voltage of Zener diode 26 turning Zener diode 26 conductive, supplying increased current levels to start-up portion 24, and more specifically, to capacitor 30. In the illustrated embodiment, the breakdown voltage of Zener diode 26 is between 64.5 and 71.5 V, and preferably 68 V.

Once Zener diode 26 turns conductive (from left to right in FIG. 2) capacitor 30 begins charging. At this point, current is being supplied to start-up portion 24, but diac 32 prevents the base of transistor 20 from becoming conductive in the collector-emitter direction. As the bus voltage continues ramping up, capacitor 30 collects more charge, and eventually reaches a potential to overcome the breakover voltage of diac 32. When the breakover voltage is reached, transistor 20 turns conductive, wherein inverter starting circuit 12 begins to oscillate, and after approximately 0.7 seconds, lamp assembly 10 is ignited.

After the breakover voltage of diac 32 is reached, capacitor 30 no longer has an opportunity to continuously collect charge. Current flows directly from node 44 to capacitor 30, since transistor 20 is conductive after diac 32 breaks down. Diode 28 provides a path to allow capacitor 30 to discharge, once per cycle. The inverter starting circuit 12 now operates as is typical, with no further activity from the start-up portion 24.

With continuing attention to FIG. 2, switching transistors 20, 22 are driven by respective drive circuits 48, 50. Drive circuit 48 incorporates diode 52, resistor 54 combination supplied via coupling of winding 58. Drive circuit 50 incorporates diode 60, resistor 62 combination, supplied via coupling of windings 66. Lamp assembly 10 is provided with power from inverter starting circuit 12 by a coupling between windings 68 and 70, where winding 70 has a capacitor 72 across its primary winding and are considered resonant load components.

In the event of an over voltage occurring during lamp start-up or sudden load removal, power Zener diodes 74 and 76 will clamp the voltage to protect the BJTs from over voltage damage.

With continuing attention to FIG. 2, breakover voltage of diac 32 is chosen to be an optimal bus voltage for starting the inverter circuit and ignition voltage of lamp assembly 10. In the illustrated embodiment, the breakover voltage of diac 32 is chosen to be such that when the bus voltage (the voltage across capacitors 34 and 36) reaches a pre-determined value, for example about 390 V, diac 32 reaches its breakover voltage. Stated differently, start-up portion 24 detects when the bus voltage reaches the preferred firing voltage by virtue of the chosen breakover voltage of diac 32. In the illustrated embodiment, the breakover voltage of the diac 32 is between 20 V and 40 V, and preferably about 32 V.

Figure 3:
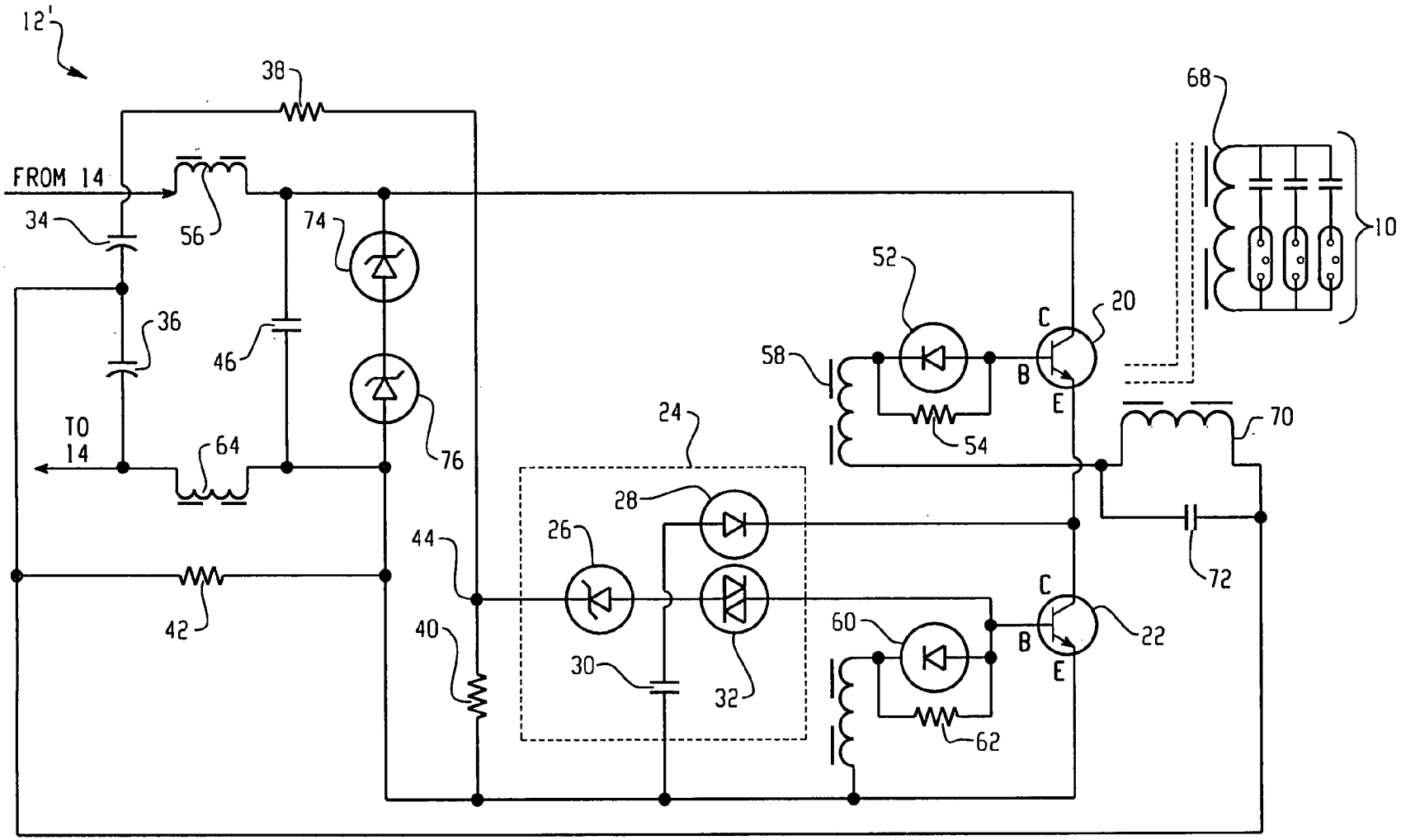
FIG. 3 is a circuit diagram similar to the ballast of FIG. 2, however the implementation of the start-up portion is on a low side switch of the inverter circuit.

It is to be understood the above description that applies to first transistor 20 is also applicable to second transistor 22. That is, as shown in FIG. 3 in an alternate inverter starting circuit 12' embodiment, the start-up portion 24 is connected to second transistor 22, and it, instead of first transistor 20, would initiate oscillations. Components having similar operation and use as components in FIG. 2 are similarly numbered as in FIG. 2.

The firing voltage is chosen to be about 300 V or greater for rapid start ballasts.

Figure 4A:
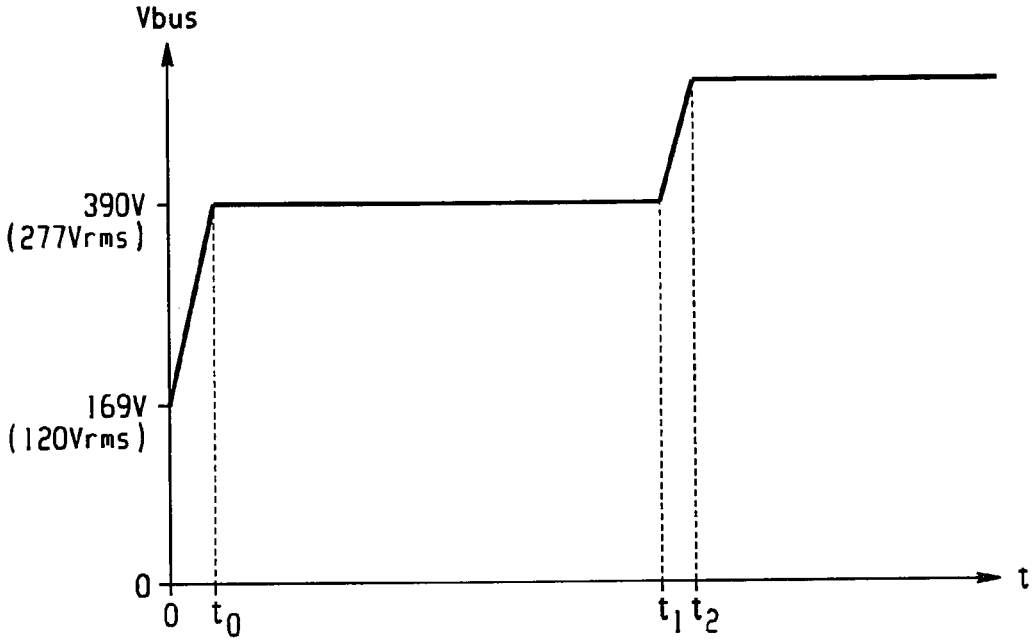
FIG. 4*a* shows the bus voltage over a time sequence for the rapid start electronic ballast according to the present application.
Figure 4B:
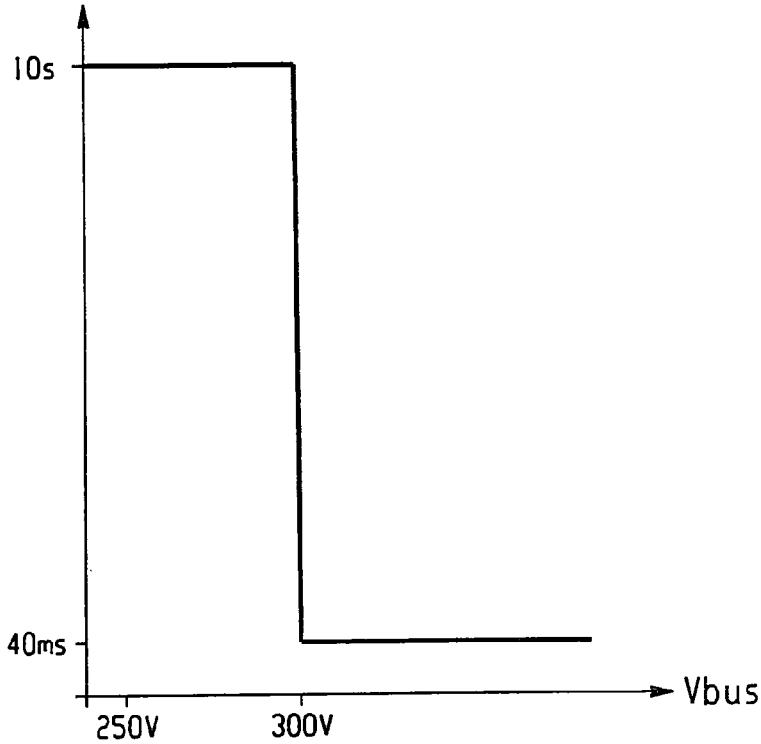
FIG. 4*b* provides a function of the bus voltage versus starting time for a rapid start electronic ballast according to the present application.

FIG. 4*a* provides a graphed time sequence of a rapid start electronic ballast incorporating inverter starting circuit 12 of the present application. As seen from this figure, the sequence includes three distinct transitions. Fo a 120 V input line, from turn-on (0) to $t_0$ the bus voltage transitions from its starting voltage (e.g. 169 V) to a preferred pre-heat voltage (e.g. 390 V). The time duration to $t_0$-$t_1$ is a pre-heat time (e.g. steady 390 V), and from $t_1$ to $t_2$, the bus voltage ramps up to its steady state (e.g. 500 V). Turning attention to FIG. 4*b*, depicted is a chart showing inverter starting time for a rapid start electronic ballast incorporating inverter starting circuit 12. Viewing FIGS. 4*a* and 4*b* together emphasizes the starting time is controlled by the bus voltage of the circuit. For example if the bus voltage is less than 300 V, the lamp will take approximately 10 seconds to start, however, when the bus voltage is 300 V or more, the start time is reduced to approximately 40 milliseconds. FIG. 4*b* illustrates the voltage dependency of the circuit, and emphasizes that operation to start the circuit is not a time dependent factor but is rather a voltage controlled concept. There is no pre-determined time following energization that the oscillations will begin. Rather, in the present design, following energization of the circuit, as long as the bus voltage is below a certain value (e.g. 300 V) there will, ideally, be no oscillations and only when the voltage is at or above the breakover voltage (e.g. 300 V) will the oscillations begin. Thus it is shown the starting of the circuit is controlled by the value of the bus voltage.

Figure 5:
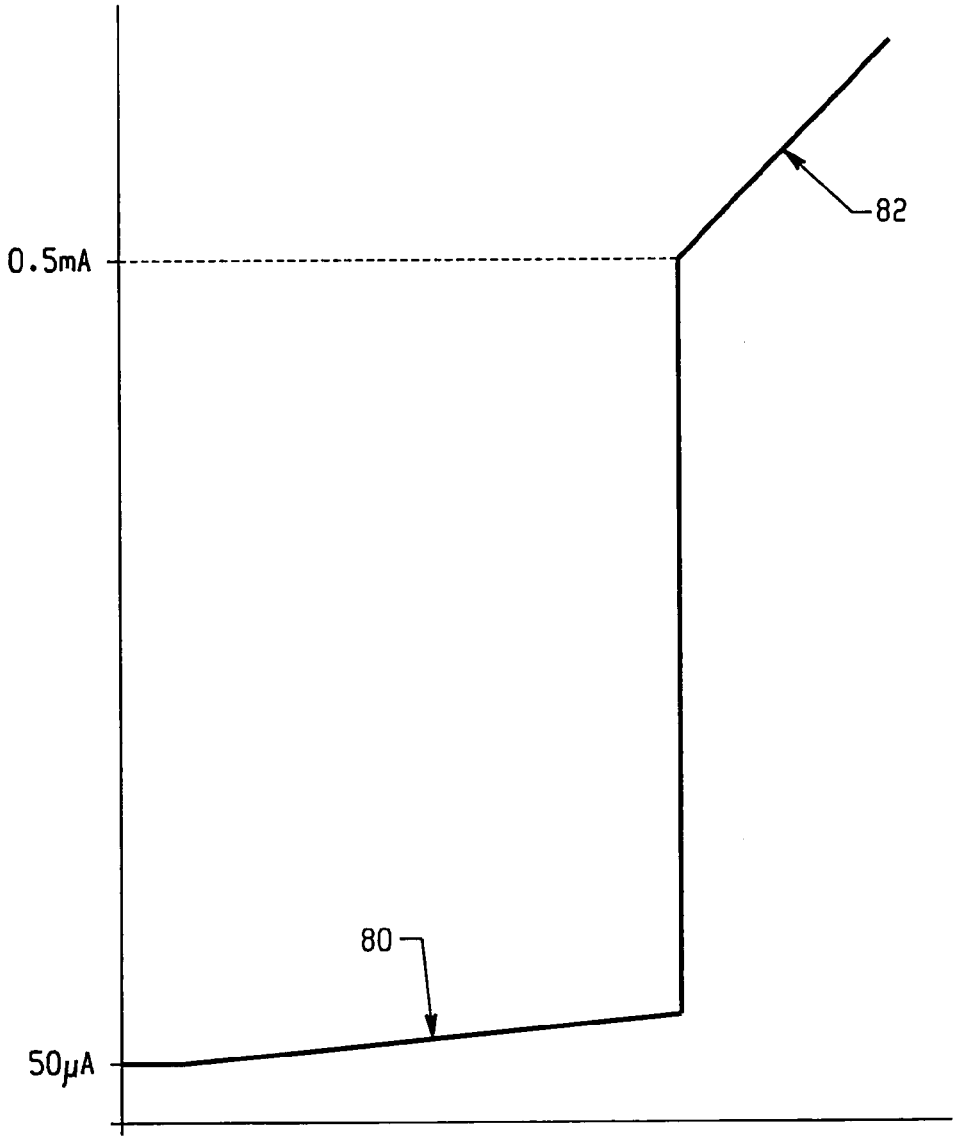
FIG. 5 depicts the charge current of capacitor 30 of FIG. 2 as a function of the bus voltage.

Turning now to FIG. 5, depicted is operation of charge capacitor 30 of FIG. 2, which illustrates its two distinct charging rates. Charge capacitor 30 will always have an amount of stored energy to be used for the breakover of diac 32. As seen, when the bus voltage is over 300 V, capacitor 30 charges at a very quick rate, and when below 300 V bus voltage, capacitor 30 is being charged only due to leakage current. Particularly, when the bus voltage is less than 300 V, Zener diode 26 never turns conductive in its reverse direction, and allows only a leakage current 80 to charge capacitor 30. After the bus voltage reaches 300 V, a significantly higher charging current 82 is available to capacitor 30.

Another consideration in selecting the threshold voltage is the starting bus voltage. For a 120 V line input, the output bus voltage ramps up from about 169 V. For a 277 V line input, the output bus voltage ramps up from about 390 V. As stated earlier, the start time (FIG. 4*b*) is about 40 milliseconds at 390 V. After lamp assembly 10 is ignited, the bus voltage continues to ramp up to steady state operating voltage V. Thus, one exemplary firing voltage is 390 V, because it is greater than the 300 V required for mode transition, is less than common steady state operating voltages, and fires the lamp as soon as possible, before the bus voltage reaches steady state. Of course, greater or lesser firing voltages can be chosen, for example in some applications the bus voltage may experience an overshoot during start-up, based on known line voltages and desired universality of the inverter.

Thus, from the foregoing, it is shown (FIGS. 2 and 3) are two implementations of a new starting circuit in conjunction with a current fed, half-bridge inverter circuit. The main bus voltage is sensed by a three resistor divider circuit. A portion of the bus voltage is applied to a Zener diode and a charging capacitor. When the voltage reaches a pre-determined level, the Zener diode breaks down, allowing the charging capacitor to charge. A diac then breaks down, causing the self-oscillating inverter to be triggered. A diode prevents the charging capacitor from charging, allowing it to discharge every half-cycle, when a first transistor is on. The component values are selected such that the Zener breakdown voltage is at least double the diac breakdown voltage, or higher. Possible applications of the present invention include General Electric's 4 ft. and 8 ft. T12 and T8 electronic lamp ballasts.

Exemplary component values for the circuits of FIGS. 2 and 3 are as follows:

| Part Description | Part Number | Nominal Value |
|---|---|---|
| Lamp Assembly | 10 | 40 Watts |
| Line Voltage | 16 | 120–277 Volts |
| First Transistor | 20 | BJT SPB 11NM60 |
| Second Transistor | 22 | BJT SPB 11NM60 |
| Bus Capacitor | 34 | 33 μf |
| Bus Capacitor | 36 | 33 μf |
| Bus Resistor | 38 | 400 kΩ |
| Bus Resistor | 40 | 620 kΩ |
| Bus Resistor | 42 | 1 MΩ |
| Zener Diode | 26 | 68 V |
| Diode | 28 | UF 4007 |
| Capacitor | 46 | 1.2 nf |
| Charging Capacitor | 30 | 0.1 μf |
| Diac | 32 | HT-32 |
| Zener Diode | 74 | P6KE440A |
| Zener Diode | 76 | P6KE440A |
| Inductive Winding | 56 | 5 mh |
| Inductive Winding | 64 | 5 mh |
| Base Diode | 52 | 1N5817 |
| Base Diode | 60 | 1N5817 |
| Base Resistor | 54 | 75 Ω |
| Base Resistor | 62 | 75 Ω |
| Inductive Winding | 70 | 0.85 Henries |
| Inductive Winding | 68 | 1.27 Henries |
| Capacitor | 72 | 12 nf |

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A lamp inverter starting circuit comprising:

a switching portion that converts a bus voltage signal into an alternating current signal;

an input portion that receives the bus voltage signal, wherein the bus voltage signal ranges up to 390V;

a resonant load portion for receiving a lamp load; and a voltage controlled start-up portion that delays triggering of the inverter starting circuit based on the input bus voltage signal.

2. The lamp inverter starting circuit as set forth in claim 1, wherein the switching portion includes first and second power transistors.

3. The lamp inverter starting circuit as set forth in claim 2, wherein the transistors are one of bipolar junction transistors and field effect transistors.

4. The lamp inverter starting circuit as set forth in claim 1, further including:

an input AC line voltage source ranging from 120 V to 280 V.

5. The lamp inverter starting circuit as set forth in claim 1, wherein the start-up portion includes at least one charging capacitor that collects charge prior to triggering of the inverter starting circuit.

6. The lamp inverter starting circuit as set forth in claim 5, wherein the at least one charging capacitor charges to a threshold voltage.

7. The lamp inverter starting circuit as set forth in claim 6, wherein the startup portion includes at least one diac that has a breakdown voltage that determines the threshold voltage.

8. The lamp inverter starting circuit as set forth in claim 7, wherein the at least one charging capacitor charges to the breakdown voltage prior to triggering the inverter starting circuit.

9. The lamp inverter starting circuit as set forth in claim 6, wherein the threshold voltage is 390 V.

10. A method of firing a lamp comprising:

supplying an AC line voltage;

converting the AC line voltage into a DC bus voltage;

charging a capacitor with current supplied by the bus voltage;

overcoming a breakdown voltage of a diac by ramping the bus voltage up to between about 300V to about 500V, turning the diac conductive when the charged capacitor reaches the diac breakdown voltage; and supplying voltage to the lamp after the diac turns conductive.

11. The method as set forth in claim 10, wherein the step of overcoming the breakdown voltage includes discharging the capacitor.

12. The method as set forth in claim 10, wherein the step of supplying the AC line voltage includes electrically connecting the lamp to an AC voltage source, the voltage source ranging from 120 V to 280 V.

13. The method as set forth in claim 10, wherein the step of supplying voltage to the lamp occurs before the bus voltage reaches a steady state.

* * * * *